United States Patent [19]

Acosta

[11] 4,454,080

[45] Jun. 12, 1984

[54] FUEL FLOW AUTOMATIC MODULATING AND ECONOMIZING CARBURETOR JET ASSEMBLY

[75] Inventor: Cristobal Acosta, Los Rozales, Venezuela

[73] Assignee: Fadeipca International, Corp., Miami, Fla.

[21] Appl. No.: 360,990

[22] Filed: Mar. 23, 1982

[51] Int. Cl.[3] ..... F02M 3/04

[52] U.S. Cl. ..... 261/41 D; 261/DIG. 19; 261/DIG. 38

[58] Field of Search ..... 261/DIG. 38, 41 D, DIG. 19

[56] References Cited

U.S. PATENT DOCUMENTS

| | | | |
|---|---|---|---|
| 2,214,964 | 9/1940 | Leibing | 261/DIG. 19 |
| 2,763,285 | 9/1956 | Reeves | 261/DIG. 38 |
| 2,962,269 | 11/1960 | Stanton | 261/DIG. 38 |
| 2,970,822 | 2/1961 | Ernest | 261/DIG. 38 |
| 3,156,333 | 11/1964 | Barnes | 261/41 D |
| 3,677,526 | 7/1972 | Pierlot | 261/41 D |
| 3,996,909 | 12/1976 | Fischer | 261/DIG. 19 |
| 4,124,662 | 11/1978 | Morita | 261/41 D |
| 4,146,594 | 3/1979 | Raud | 261/41 D |
| 4,349,489 | 9/1982 | Gaget et al. | 261/DIG. 38 |

FOREIGN PATENT DOCUMENTS

| | | | |
|---|---|---|---|
| 1576536 | 6/1970 | Fed. Rep. of Germany | 261/DIG. 19 |
| 2442971 | 6/1980 | France | 261/DIG. 38 |

*Primary Examiner*—Tim R. Miles

*Attorney, Agent, or Firm*—Harvey B. Jacobson

[57] ABSTRACT

A valve assembly is provided for replacing the idle mixture jet screw of a conventional carburetor and includes structure for aerating the liquid fuel metered by the valve assembly, adjustably metering the aerated fuel supplied to the associated carburetor idle fuel port during idle operation mode of an associated combustion engine, increasing the flow of aerated fuel through the idle fuel port responsive to increase of engine speed while the associated throttle valve is open and at the same time effectively decreasing venturi vacuum of the associated carburetor and thus reducing carburetor main jet fuel flow, and reducing flow of fuel through the idle fuel port below idle mode fuel flow when the engine is operating under an engine braking mode, and reducing fuel flow during cruising operation mode; and also in the said three operating modes reducing the CO (carbon monoxide) in the residual of combustion; this as a result of a most complete combustion.

9 Claims, 3 Drawing Figures

FUEL FLOW AUTOMATIC MODULATING AND ECONOMIZING CARBURETOR JET ASSEMBLY

BACKGROUND OF THE INVENTION

In conventional carburetors, the throttle linkage is not only connected to the throttle valve shaft of the carburetor, but also to an accelerator pump whereby movement of the carburetor linkage to increase the opening of the throttle valve effects operation of the accelerator pump an amount proportional to the increase of throttle plate opening. The accelerator pump is provided in order to insure an adequate supplemental supply of fuel to the induction passages of an associated combustion engine at the time the throttle plate is opened and before an increased flow of air through the carburetor venturi can effect an increase flow of fuel into the carburetor venturi area through the main jet of the carburetor. However, the main jet of the carburetor must, soon after the throttle plate is opened, be capable of delivering sufficient amounts of fuel for proper combustion of the air and fuel mixture during acceleration mode of operation and this is accomplished by an increase of venturi vacuum as a result of an increase in the speed of induction air passing through the carburetor venturi area. On the other hand, after acceleration has been accomplished and continued operation of the engine at speed is carried out at the same throttle opening, the delivery of fuel to the carburetor venturi by the main jet tends to be in excess of that amount which is necessary to support maximum efficiency. Still further, when a carburetor equipped engine is functioning under an engine braking mode, the amount of fuel supplied to the induction passages of the engine through the idle fuel port of the carburetor is totally excessive, inasmuch as no delivery of fuel is needed during an engine braking mode.

Accordingly, a need exists for a carburetor incorporating structure which will be capable of reducing the amount of fuel supplied to the induction passages thereof after cruising speed has been reached and for reducing the amount of fuel supplied to the induction passages of the engine through the idle fuel port of the associated carburetor during engine braking mode operations.

Still further, inasmuch as conventional carburetors utilize an idle fuel delivery system which does not promote atomization of the idle fuel being supplied during idle mode operation, a need exists for a carburetor incorporating structure which will function to more completely atomize or break-up liquid droplets of fuel being supplied to the induction passage through the carburetor idle fuel port.

There have been various forms of fuel economizing jets incorporating air passages formed therethrough whereby the idle fuel supplied to the induction passages of a carbureted engine may be aerated and thus broken up into smaller liquid droplets. One example of this type of jet is disclosed in French Pat. No. 2,307,140 and a second similar type of perforated idle jet screw is disclosed in Venezuelan patent Register No. 29,943. However, these previously known idle fuel controlling jets are effective only during the idle mode of operation of an associated combustion engine and offer no means to reduce main jet fuel discharge during a cruising mode of operation or to reduce the discharge of fuel from an idle fuel port during an engine braking mode of operation.

SUMMARY OF THE INVENTION

The valve assembly of the instant invention is provided as a replacement for a conventional idle fuel jet needle and is to be readily installed in lieu of a conventional idle fuel jet needle. The valve assembly requires only a source of filtered ambient air and a source of carburetor vacuum. Accordingly, the valve assembly is to be readily used as a retrofit item or incorporated into the manufacture of new carburetors.

The main object of this invention is to provide a carburetor idle jet needle valve assembly which will function as a fuel economizing item and reduce fuel consumption at idle, during engine braking mode and during cruising mode operation; and reducing the CO(-carbon monoxide) in the residuals of combustion at idle, during engine braking mode and during cruising operation mode.

Another object of this invention is to provide an assembly in accordance with the preceding object and which may be used as a retrofit item or incorporated in the manufacture of new carburetors.

Still another object of this invention is to provide an improved idle jet needle valve assembly which will be capable of more precisely metering the flow of fuel through a carburetor idle fuel port during engine idle operations.

A final object of this invention to be specifically enumerated herein is to provide an improved idle jet needle valve assembly in accordance with the preceding objects and which will conform to conventional forms of manufacture, be of simple construction and easy to adjust so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
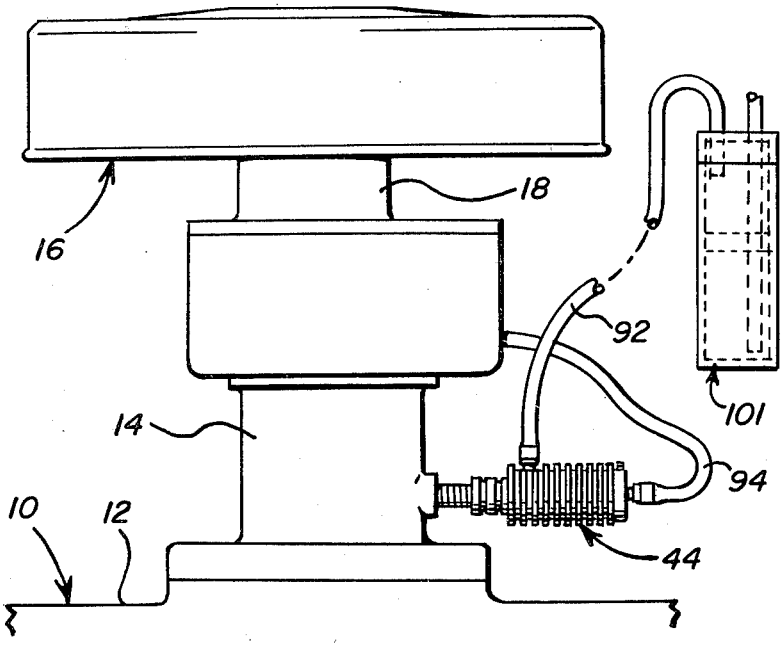
FIG. 1 is a fragmentary side elevational view of a conventional type of carburetor and an adjacent portion of an associated combustion engine intake manifold and with the valve assembly of the instant invention operatively associated with the carburetor.
Figure 2:
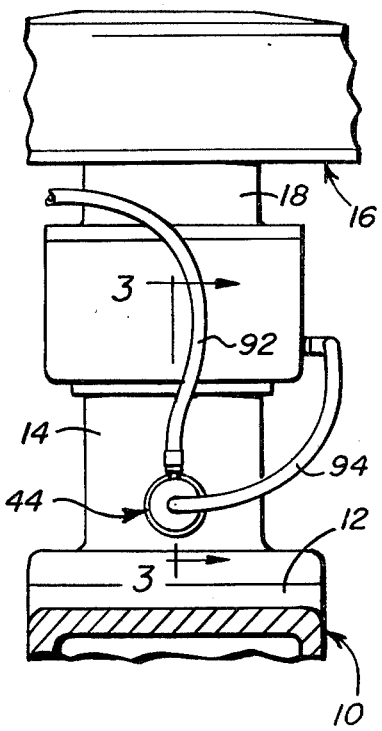
FIG. 2 is an elevational view of the assemblage illustrated in FIG. 1 as seen from the right side thereof.

Referring now more specifically to the drawings, the numeral 10 generally designates a conventional form of naturally aspirated, reciprocating piston internal combustion engine including an intake manifold 12 upon which a conventional carburetor 14 is mounted. A conventional air cleaner assembly referred to in general by the reference numeral 16 is mounted on an upper air horn portion 18 of the carburetor 14.

Figure 3:
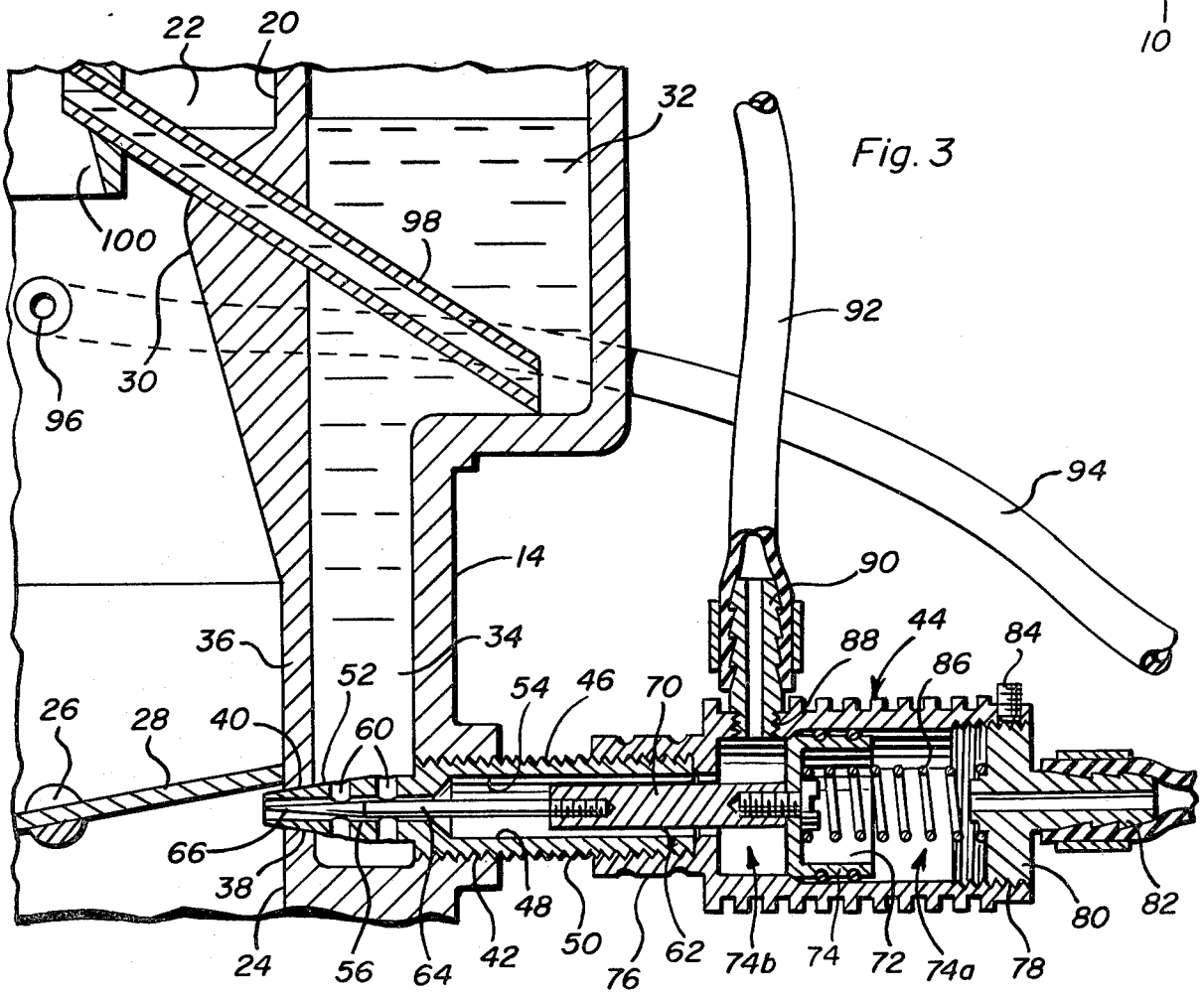
FIG. 3 is an enlarged fragmentary vertical sectional view taken substantially upon the plane indicated by the sectional line 3—3 of FIG. 2.

With attention now invited more specifically to FIG. 3 of the drawings, it may be seen that the carburetor 14 includes an air and fuel passage 20 formed therethrough including an upper end portion 22 which opens upwardly into the air cleaner assembly 16 through the air horn portion 18, a lower outlet end portion 24 in which a conventional diametric throttle valve shaft 26 is oscillatably supported having a throttle plate 28 supported thereon and an intermediate venturi portion 30. In addition, the carburetor 14 includes a float chamber 32 in which a conventional fuel inlet flow controlling float (not shown) is disposed and the chamber 32 includes a lower portion 34 separated from the one peripheral portion of the passage 20 by a wall portion 36 having an idle fuel port 38 formed therethrough. The idle fuel port 38 includes a first inner end 40 opening into the passage 20, a second internally threaded outer end 42 opening outwardly of the carburetor 14 and an intermediate portion disposed between the first and second end portions 40 and 42 opening directly into the lower portion 34 of the fuel chamber 32. Conventionally, a threaded jet needle is threaded into the second end portion 42 of the port 38 and includes a tapered inner end at least partially seated within the first end 40 of the port 38 to throttle the flow of fuel from the lower portion 34 of the chamber 32 through the port 38 and into the passage 20 during engine idle operations.

However, in accordance with the present invention, the conventional threaded jet needle (not shown) is replaced by the valve assembly of the instant invention which is referred to by the reference numeral 44. The valve assembly 44 includes a tubular needle valve body 46 defining a central passage 48 therethrough. The body 46 includes a diametrically enlarged externally threaded outer end portion 50 which is threaded in the second outer end 42 of the port 38 and a diametrically reduced and externally tapered inner end portion 52 which extends across the lower portion 34 of the fuel chamber 32 and projects into the first end 40 of the port 38. The passage 48 includes a first large diameter end portion 54 disposed in the outer end portion 50 and a diametrically reduced end portion 56 disposed in the inner end portion 52. The inner end portion 52 includes lateral fuel passages 60 formed therein communicating the diametrically reduced end portion 56 of the passage 48 with the interior of the lower portion 34 of the fuel chamber 32.

A jet needle referred to in general by the reference numeral 62 is provided and includes a first diametrically reduced end 64 which projects into the diametrically reduced end portion 56 of the passage 48 and includes a tapered tip 66 and an enlarged end 70 remote from the tip 66 and having a piston cup 72 mounted thereon. A cylinder 74 consisting of two parts with different diameters 74A–74B includes an internally threaded nipple 76 on one end threaded on the outer end portion 50 of the valve body 46 and the piston cup 72 is reciprocal within the cylinder 74. The end of the cylinder 74 remote from the nipple 76 is internally threaded as at 78 and has an apertured end wall 80 threadedly secured therein provided with an inlet nipple 82 opening therethrough. The cylinder 74 includes a set screw 84 for engagement with the end wall 80 to retain the latter in adjusted threaded position within the cylinder 74. A compression spring 86 is disposed in the first part 74A of the cylinder, between the outer side of the piston cup 72 and the inner side of the end wall 80. In the second part of the cylinder 74-B there is a lateral inlet port 88 in which an air inlet nipple 90 is secured.

A flexible hose 92 has one end thereof secured over the inlet nipple 90 and the other end thereof opens into the interior of an oil-humidity filter 101. In addition, one end of the hose 94 is engaged over the nipple 82 and the other end of the hose 94 engages with the venturi vacuum conection of carburator 96.

In operation, the valve body 46 may be threaded into the second end 42 of the port 38 until the tapered end portion 52 thereof seats fully in the first end 40 of the port 38 and the nipple 76 of the cylinder 74 may be adjusted on the outer end portion 50 of the valve body 46 in order to adjust the longitudinal positioning of the tapered tip 66 of the jet needle 62 within the diametrically reduced end portion 56 of the passage 48 to achieve the desired amount of idle fuel required during idling operation mode of the engine 10. However, if it is desired for smoother engine operation at idle, the end portion 52 may not be fully seated in the first end 40 of the port 38.

As fuel enters the diametrically reduced end portion 56 of the passage 48 for movement through the port 38, that amount of fuel is aerated by ambient air drawn in through the nipple 90 and moving inwardly along the central passage 48 of the tubular valve body and through the diametrically reduced end portion 56 of the passage 48 to the end port 40. This aerated fuel is broken up into smaller fuel droplets and therefore is capable of supporting smoother engine idle operations; with reduced CO(carbon monoxide) residuals. However, although the spring 86 tends to move the jet needle 62 toward its limit position to the left, as viewed in FIG. 3 of the drawings, as the flow of air through the venturi 30 increases, the pressure at the end 96 of the hose 94 is reduced and that reduced pressure is communicated with the interior of the cylinder 74 to the right side of the piston cup 72 by the hose 94 and thereby tends to draw the piston cup 72 to the right, as viewed in FIG. 3 of the drawings. Thus, additional amounts of fuel and air are admitted into the outlet end portion 24 of the passage 20 through the port 38 and additional ambient air entering the nipple 90 is allowed to pass through the valve assembly 44 and into the passage 20. This, of course, reduces the amount of air which must pass through the passage 20 upstream from the throttle plate 28 and thereby reduces the amount of fuel which is drawn up into the tube 98 from the float chamber 32 and discharged from the main jet 100. Accordingly, while an additional amount of fuel is discharged into the passage 20 through the port 38, a greater reduction of fuel flowing in the main jet 100 is realized, the inlet end of the tube 98 being under the control of the main jet (not shown) of the carburetor 14.

In the engine braking mode of operation wherein an associated vehicle may be driving the engine 10 while the throttle plate 28 of the carburetor 14 is in the idle position, the increase of engine vacuum downstream from the throttle plate when a conventional idle mixture screw is used causes more fuel flow from the outer part 38 through the lower part of chamber 32. However, when the valve assembly 44 is used, the needle 64 will partially close the diametrically reduced end portion 56 of passage 48 in order to reduce the fuel flow through idle port 38. Accordingly, when the engine 10 is operated with a conventional idle mixture screw it would draw more fuel from idle port 38 trough the lower part of chamber 32; but using the the assembly valve, then the needle 64 will partially close the diametrically reduced end portion 56 of passage 48 and the fuel flow is reduced. Accordingly, when the engine 10 is operating under engine braking conditions, the supply of fuel provided through the port 38 into the passage 20 is reduced below that quantity which is admitted into the passage 20 during engine idle operations.

The axial positioning of the inner end portion 52 relative to first inner end 40 of port 38 may be adjusted by threaded adjustment of the valve body 46 in the second end portion 42 of port 38. Further, the biasing action of the spring 86 on the piston cup 72 may be varied by threaded adjustment of the end wall 80 relative to the cylinder 74. Also, the axial positioning of the needle 62 relative to the inner end portion 52 may be varied by threaded adjustment of the nipple 76 relative to the body 46.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a carburetor of the type including an air and fuel mixture passage extending therethrough, a throttle plate shiftable between open and closed positions, an idle fuel port opening into said passage immediately downstream from said throttle plate and a vacuum port opening into a venturi portion of said passage upstream from said throttle plate and subject to increases in vacuum as the speed of said air flow through said passage increases, said idle fuel port including a first end opening into said passage, a second end opening outwardly of said carburetor and an intermediate portion opening into a chamber of said carburetor having liquid fuel therein; the improvement comprising a combined idle fuel adjustment, idle fuel aeration and high speed engine fuel consumption reduction valve assembly, said valve assembly including a tubular needle valve body defining a central passage extending therethrough and threaded in said idle port second end, said tubular needle valve body including a hollow externally tapered inner end tip adjustable axially of said first end of said idle fuel port, said tubular needle valve body including at least one lateral port means formed therein outwardly of said inner end tip opening outwardly into the intermediate portion of said idle fuel port and an outer open end, a needle valve loosely reciprocal in said central passage and including a first tapered end axially shiftable past said lateral port means toward and away from said inner end tip, and force means operatively associated with said needle valve for biasing said needle valve inwardly toward an inner limit position and to progressively shift said needle valve outwardly from said inner limit position responsive to increases in engine speed of operation as sensed at said venturi vacuum port while said throttle plate is in an open position.

2. The carburetor of claim 1 wherein said force means includes means operative to variably shift said needle valve means responsive to variations in vacuum in said venturi portion upstream from said throttle plate.

3. The carburetor of claim 1 wherein said needle valve body includes ambient air inlet means operative to admit ambient air into said central passage outwardly of said lateral port means for movement of said ambient air inwardly through said central passage, past said lateral port means and outwardly of said inner end through said idle fuel port with the ambient air admixing with and aerating the idle fuel entering said central passage through said lateral port means and moving toward said tapered inner end tip.

4. The carburetor of claim 3 wherein said ambient air inlet means includes means for filtering the ambient air passing therethrough.

5. The carburetor of claim 1 wherein said force means includes spring means yieldably inwardly biasing said needle valve, venturi vacuum actuated vacuum motor means connected between said body and needle valve operative to increasingly outwardly bias said needle valve against the biasing action of said spring means responsive to increases in venturi vacuum, and ambient air inlet means open to said idle fuel port second end and communicated with said vacuum motor means for modulating the effect of said venturi vacuum thereon in proportion to the amount of ambient air passing through said ambient air inlet means.

6. The carburetor of claim 5 wherein said force means includes means operative to axially adjust the inner limit position of said needle valve relative to said needle valve body.

7. The carburetor of claim 5 wherein said force means includes means operative to variably adjust the biasing action of said force means biasing said needle valve toward its inner limit position.

8. The carburetor of claim 7 wherein said force means includes means operative to axially adjust the inner limit position of said needle valve relative to said needle valve body.

9. For use in conjunction with a carburetor of the type including an air and fuel mixture passage extending therethrough, a throttle plate shiftable between open and closed positions, an idle fuel port opening into said passage immediately downstream from said throttle plate and a vacuum port opening into a venturi portion of said passage upstream from said throttle plate and subject to increases in vacuum as the speed of said air flow through said passage increases, said idle fuel port including a first end opening into said passage, a second end opening outwardly of said carburetor and an intermediate portion opening into a chamber of said carburetor having liquid fuel therein; a combined idle fuel adjustment, idle fuel aeration and high speed engine fuel consumption reduction valve assembly, said valve assembly including a tubular needle valve body defining a central passage extending therethrough and for mounting in said idle fuel port second end, said needle valve body including an externally tapered inner tip end for seating in said first end of said idle fuel port, at least lateral port means for communication with the intermediate portion of said idle fuel port and an open outer end, a needle valve loosely reciprocal in said central passage and including a first tapered end axially shiftable past said lateral port means toward and away from said inner end tip, and force means operatively associated with said needle valve for biasing said needle valve inwardly toward an inner limit position and to progressively shift said needle valve outwardly from said inner limit position responsive to increase in engine speed of operation as sensed at said venturi vacuum port while said throttle plate is in an open position.

* * * * *